US005803580A

United States Patent [19]

Tseng

[11] Patent Number: 5,803,580

[45] Date of Patent: Sep. 8, 1998

[54] DECORATIVE LIGHT

[76] Inventor: Yang-Hsu Tseng, P.O. Box 2103, Taichung, Taiwan

[21] Appl. No.: 935,055

[22] Filed: Aug. 22, 1997

[51] Int. Cl.[6] ..... F21V 9/00

[52] U.S. Cl. ..... 362/96; 362/123; 362/318; 362/806; 362/811

[58] Field of Search ..... 362/96, 318, 806, 362/811, 101, 123, 293; 40/410, 427, 431

[56] References Cited

U.S. PATENT DOCUMENTS 4,170,035 10/1979 Walker ..... 362/96
4,190,312 2/1980 Bailey ..... 362/96
4,742,439 5/1988 Choate ..... 362/318
5,430,629 7/1995 Belliveau et al. ..... 362/318

*Primary Examiner*—Thomas M. Sember

[57] ABSTRACT

A decorative light is disclosed. It includes a hollow base seat having a bulb seat on bottom portion for a bulb to fit in. The bulb is surrounded by a thermally insulated sheet which is spaced from the base seat and the bulb by a certain distance. A top end of the base seat is formed with a through hole in which a container is fitted. The container contains a liquid inside, which is dyed into a predetermined color and mixed with a plurality of polished plates. In use, the bulb radiates light and heat to the container to stir up the liquid, so that the polished plates are rolled to reflect the light and create a dynamic flickering effect.

5 Claims, 6 Drawing Sheets

DECORATIVE LIGHT

BACKGROUND OF THE INVENTION

The present invention relates to a decorative light which is able to create dynamic reflection of light.

FIGS. 1 and 2 show a conventional Christmas decorative light 1 including a bulb seat 11 and a bulb 12 inserted in the bulb seat 11. Many such lights 1 are serially connected and wound around a Christmas tree 13 to create illuminating and decorative effects. The conventional bulb 12 can only emit light with single color without change so that only a monotonous effect is achieved. Also, the light emitted from the bulb 12 is directly projected without refraction so that the light is strong and can hardly achieve a soft feeling. In addition, such Christmas light 1 can only provide a static decorative effect which is insufficient for a joyful holiday.

SUMMARY OF THE INVENTION

It is therefore a primary object of the present invention to provide a decorative light including a hollow base seat having a bulb seat on bottom portion for a bulb to fit therein. The bulb is surrounded by a thermally insulated sheet which is spaced from the base seat and the bulb by a certain distance. A top end of the base seat is formed with a through hole in which a container is fitted. The container contains a liquid therein, which is dyed into a predetermined color and mixed with a plurality of polished plates. When used, the bulb radiates light and heat to the container to stir up the liquid contained therein, whereby the polished plates are rolled to reflect the light and create a dynamic flickering effect.

The present invention can be best understood through the following description and accompanying drawings, wherein:

DETAILED DESCRIPTION OF THE PREFERRED EMBODIMENT

Figure 1:
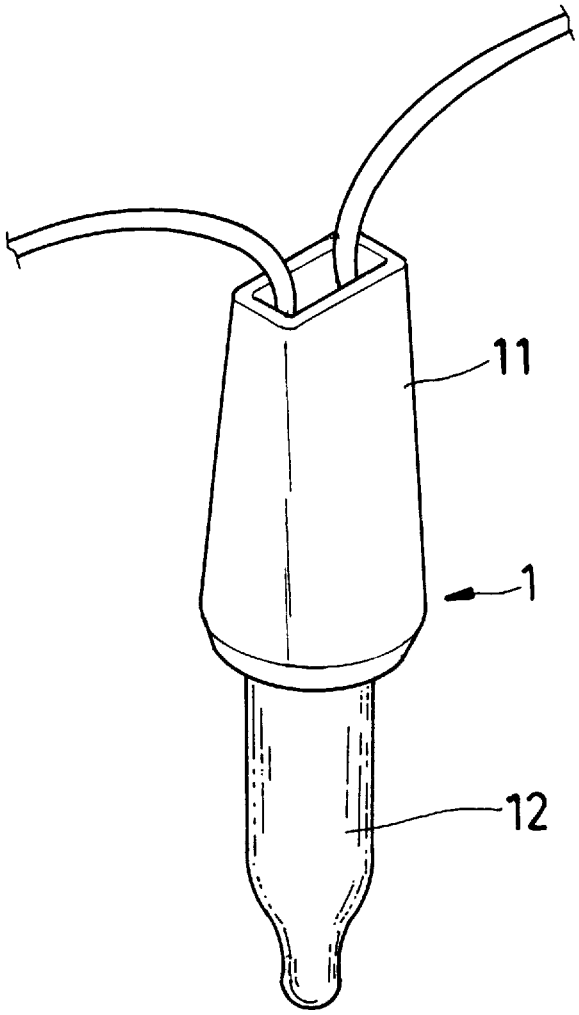
FIG. 1 PRIOR ART
FIG. 1 is a perspective view of a conventional Christmas decorative light.
Figure 2:
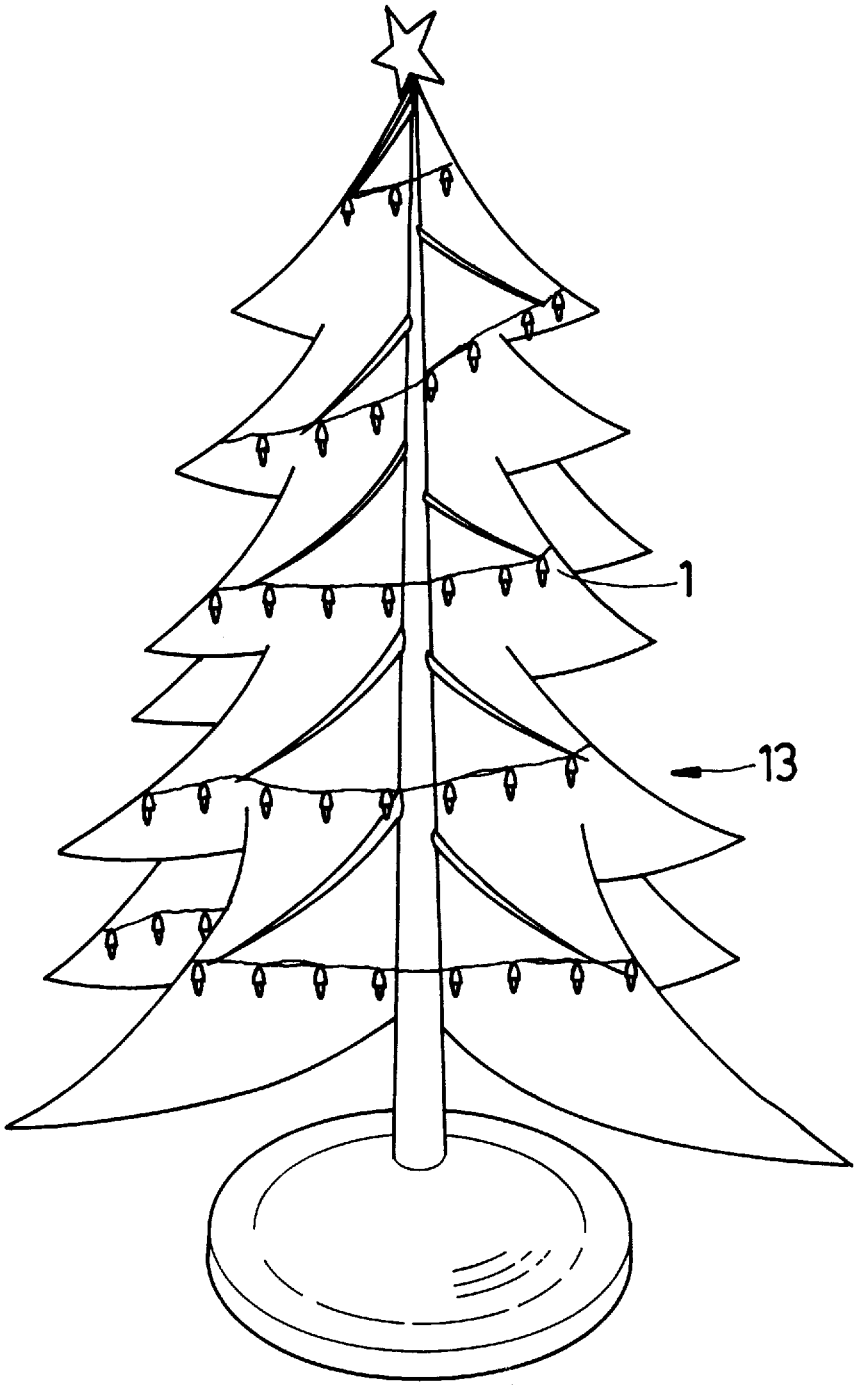
FIG. 2 PRIOR ART
FIG. 2 shows that the conventional Christmas decorative light is hung on a Christmas tree.
Figure 3:
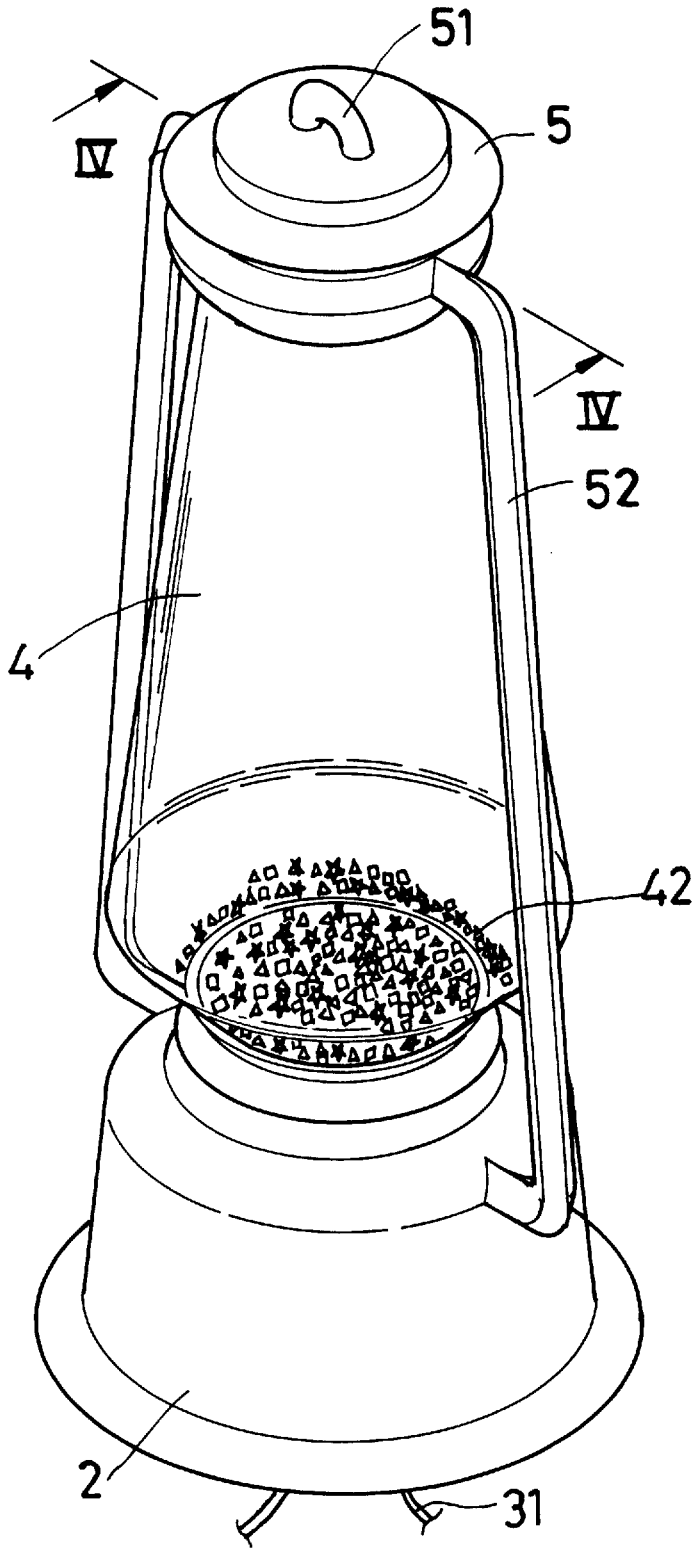
FIG. 3 is a perspective view of the present invention.
Figure 4:
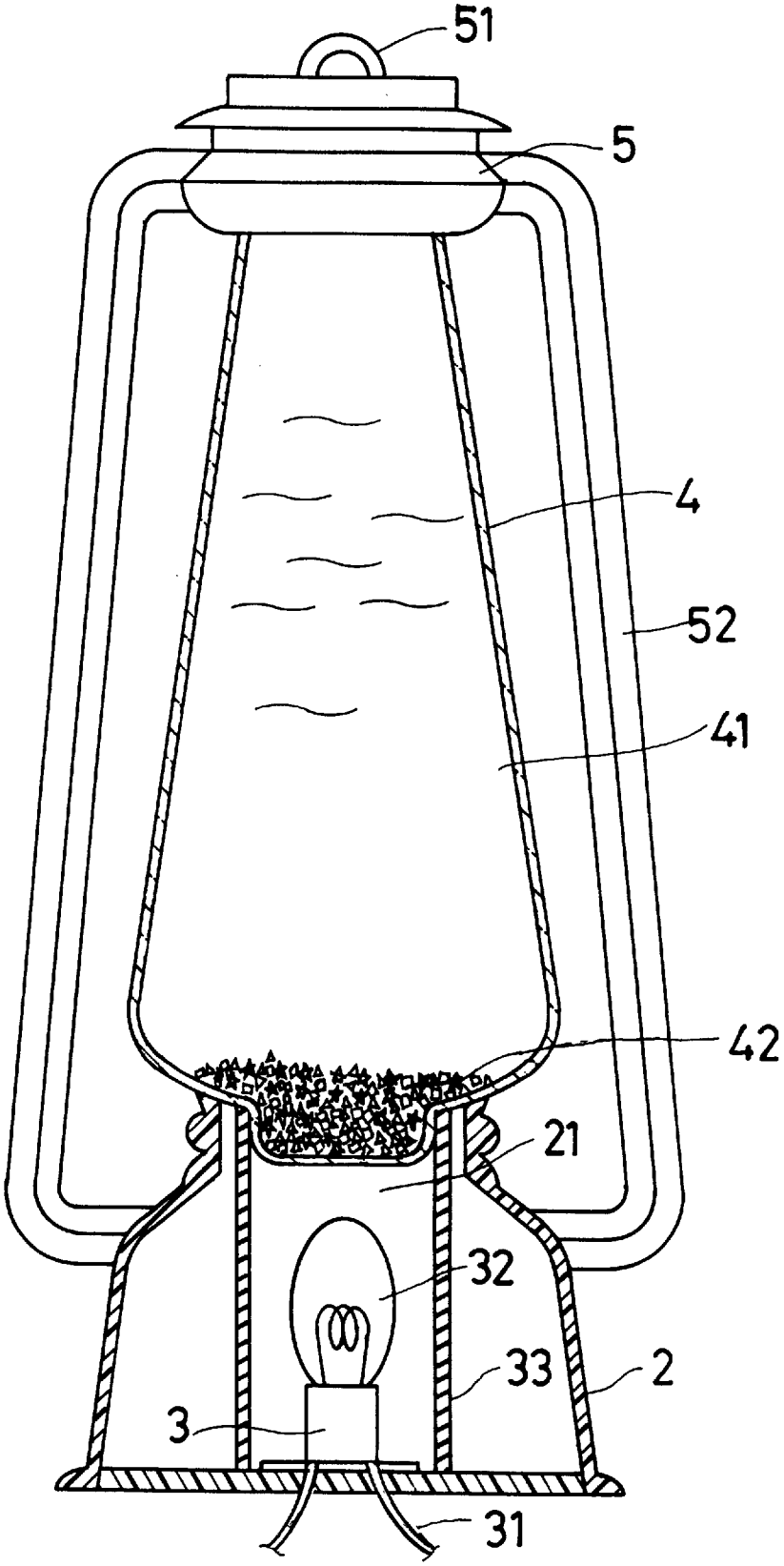
FIG. 4 is a sectional view taken along line IV—IV of FIG. 3.

Please refer to FIGS. 3 to 6. The present invention includes a hollow base seat 2 made of plastic material and vacuum electroplated with a metal coating on the surface. The bottom of the base seat 2 is disposed with a bulb seat 3 connected with a power wire 31. A bulb 32 is fitted in the bulb seat 3. The bulb 32 is surrounded by a thermally insulated sheet 33 made of bakelite. The insulated sheet 33 is spaced from the base seat 2 and the bulb 32 by a certain distance. In addition, the top end of the base seat 2 is formed with a through hole 21 in which a container 4 is fitted. The container 4 is made of transparent glass material for containing a liquid 41 therein. The liquid 41 is dyed into a predetermined color and mixed with a plurality of polished plates 42. The top end of the container 4 is disposed with a cover body 5 having a hooking lug 51 on top face. Two sides of the cover body 5 are disposed with two connecting rods 52 connected with two sides of the base seat 2.

In use, the bulb 32 will radiate heat to the container 4. The bottom of the container 4 will absorb the heat and conduct the heat to the liquid 41. By means of convection, the liquid 41 is stirred up to roll the polished plates 42. The thermally insulated sheet 33 serves to insulate the heat of the bulb 32 from affecting the electroplated metal coating on the surface of the base seat 2.

Figure 5:
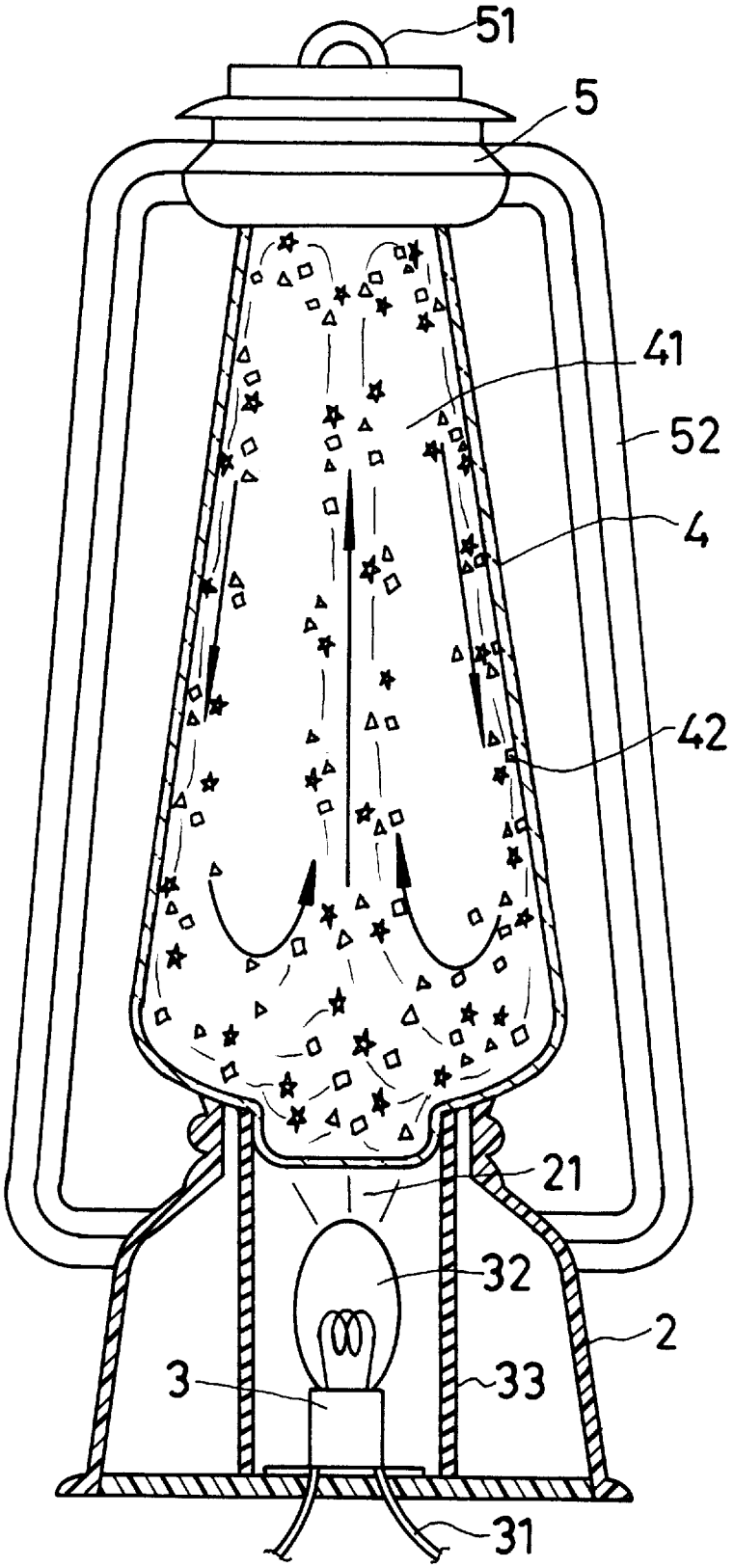
FIG. 5 is a view according to FIG. 4, showing the present invention in a used state.
Figure 6:
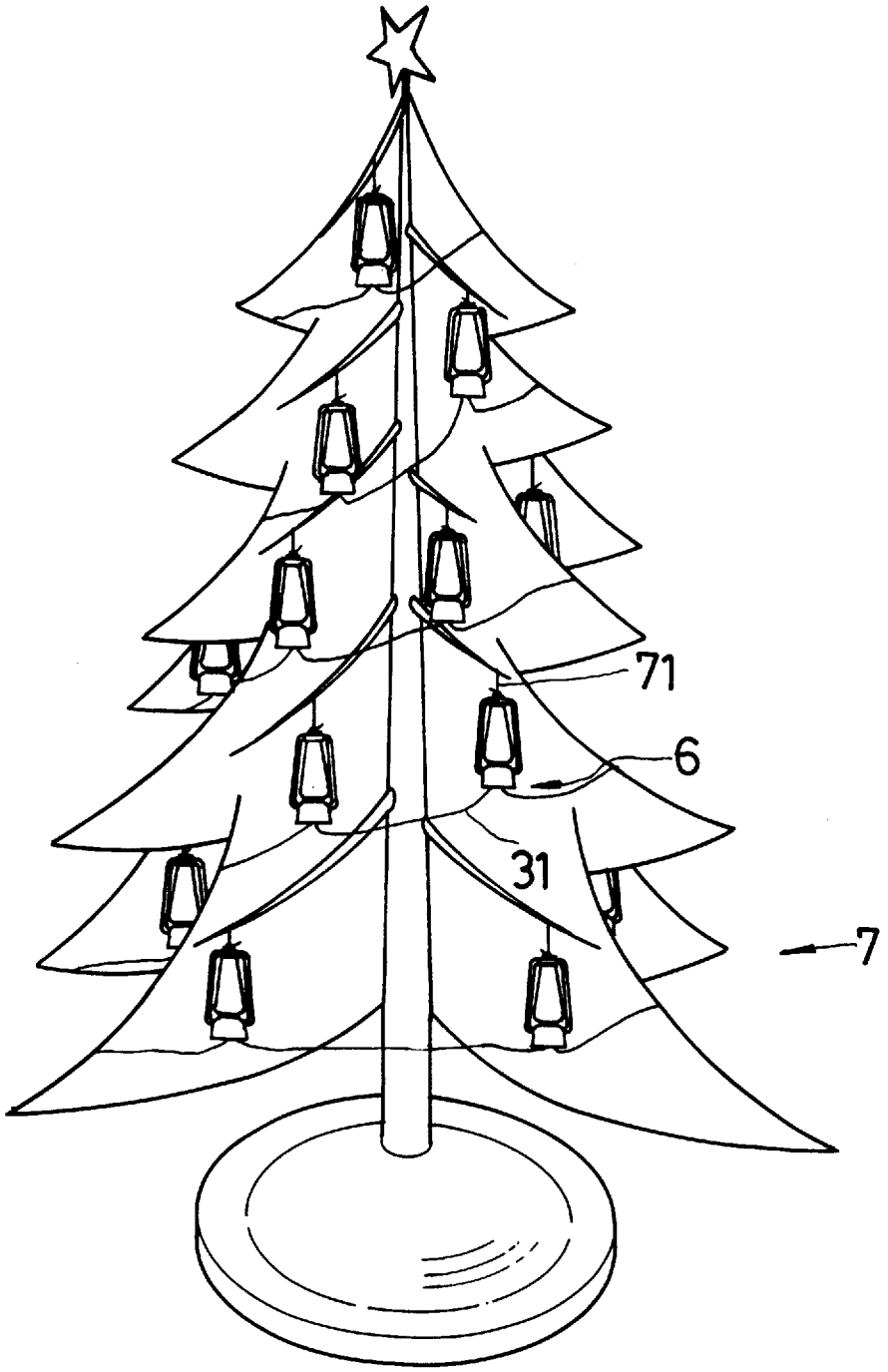
FIG. 6 shows that the present invention is hung on a tree.

Referring to FIG. 6, when used, a plurality of such bulbs are serially connected into a light string 6 and multiple hooks 71 are fixed on a tree 7. The hooking lugs 51 of the cover bodies 5 are hooked with the hooks 71 and the power wire 31 is connected to the power. As shown in FIG. 5, at this time, the bulb 32 emits light which passes through the through hole 21 into the container 4 to be refracted by the container 4 and the liquid 41 therein to achieve different colors of light. In addition, the bulb 32 also radiates heat to the container 4. The bottom of the container 4 will absorb the heat and conduct the heat to the liquid 41. Then the heat is transmitted all over the liquid 41 by convection. At this time, the liquid 41 is stirred up to roll the polished plates 42 mixed therein. As a result, the polished plates 42 reflect the light to provide a dynamic flickering effect. The thermally insulated sheet 33 serves to insulate the heat from the metal coating electroplated on the surface of the base seat 2 so as to avoid deformation thereof.

It is to be understood that the above description and drawings are only used for illustrating one embodiment of the present invention, not intended to limit the scope thereof. Any variation and derivation from the above description and drawings should be included in the scope of the present invention.

What is claimed is:

1. A decorative light comprising a hollow base seat having a bulb seat on a bottom portion, the bulb seat being connected with a power wire, a bulb being fitted in the bulb seat, the bulb being surrounded by a thermally insulated sheet which is spaced from the base seat and the bulb by a certain distance, a top end of the base seat being formed with a through hole in which a container is fitted, the container containing a liquid therein, the liquid being dyed into a predetermined color and mixed with a plurality of polished plates, a top end of the container being disposed with a cover body having a hooking lug on a top face.

2. A decorative light as claimed in claim 1, wherein the base seat is made of plastic material and vacuum electroplated with a metal coating on a surface.

3. A decorative light as claimed in claim 1, wherein the thermally insulated sheet is made of bakelite.

4. A decorative light as claimed in claim 1, wherein the container is made of transparent glass material.

5. A decorative light as claimed in claim 1, wherein lateral sides of the cover body are disposed with connecting rods connected with outer sides of the base seat.

* * * * *